US008492689B2

(12) United States Patent
Rodgers et al.

(10) Patent No.: US 8,492,689 B2
(45) Date of Patent: Jul. 23, 2013

(54) MICROWAVEABLE PACKAGE HAVING A STEAM SOURCE

(75) Inventors: Brad Dewayne Rodgers, Frisco, TX (US); Thomas Anthony Trezza, Plano, TX (US); Kevin Matthew Trick, Dallas, TX (US)

(73) Assignee: Frito-Lay North America, Inc., Plano, TX (US)

( * ) Notice: Subject to any disclaimer, the term of this patent is extended or adjusted under 35 U.S.C. 154(b) by 1629 days.

(21) Appl. No.: 11/185,402

(22) Filed: Jul. 20, 2005

(65) Prior Publication Data

US 2007/0029314 A1 Feb. 8, 2007

(51) Int. Cl.
*H05B 6/80* (2006.01)
*B65D 81/34* (2006.01)

(52) U.S. Cl.
USPC ..... 219/730; 219/731; 426/107

(58) Field of Classification Search
USPC ..... 219/725–735, 762; 426/107, 109, 426/118, 234, 241, 243; 99/DIG. 14
See application file for complete search history.

(56) References Cited

U.S. PATENT DOCUMENTS

| | | | | |
|---|---|---|---|---|
| 4,132,811 | A | | 1/1979 | Standing et al. |
| 4,137,333 | A | | 1/1979 | Daswick |
| 4,251,551 | A | | 2/1981 | VanHulle et al. |
| 4,306,133 | A | | 12/1981 | Levinson |
| 4,316,070 | A | | 2/1982 | Prosise et al. |
| 4,409,250 | A | | 10/1983 | Van Hulle et al. |
| 4,416,906 | A | | 11/1983 | Watkins |
| 4,539,454 | A | | 9/1985 | Yangas |
| 4,596,713 | A | * | 6/1986 | Burdette ..... 426/107 |
| 4,851,246 | A | | 7/1989 | Maxwell et al. |
| 4,987,280 | A | | 1/1991 | Kanafani et al. |
| 5,075,119 | A | | 12/1991 | Mendenhall |
| 5,376,392 | A | | 12/1994 | Ikegami et al. |
| 5,432,324 | A | | 7/1995 | Freewald |
| 5,488,220 | A | | 1/1996 | Frerrks et al. |
| 6,066,347 | A | | 5/2000 | Prasad et al. |

(Continued)

FOREIGN PATENT DOCUMENTS

| | | | |
|---|---|---|---|
| EP | 0 338 239 A1 | | 10/1989 |
| GB | 2225697 A | | 6/1990 |
| JP | 63-131926 | * | 6/1988 |
| JP | 2001-292708 | * | 10/2001 |

*Primary Examiner* — Quang Van
(74) *Attorney, Agent, or Firm* — Colin P. Cahoon; Amanda K. Jenkins; Carstens & Cahoon, LLP

(57) ABSTRACT

A pre-packaged microwavable food having a steam emitting source integral to the package permitting preparation of the food product in a broad range of microwave ovens. A food product is placed into a package. A steam emitting source is placed in porous communication with the food product inside the package. When the package is heated, steam blankets the food product. Steam has a positive effect on cooking performance and cooking time. The steam emitting source can be made from an absorbent material or a gel. The food product can be a half-product, pellet, or other microwavable food or snack product.

21 Claims, 4 Drawing Sheets

U.S. PATENT DOCUMENTS

| | | | | |
|---|---|---|---|---|
| 6,119,855 | A | 9/2000 | Yeager et al. | |
| 6,380,524 | B1 | 4/2002 | Keller | |
| 6,455,084 | B2 | 9/2002 | Johns | |
| 6,607,764 | B1 | 8/2003 | Keller | |
| 6,645,539 | B2 | 11/2003 | Bukowski et al. | |
| 6,645,541 | B2 | 11/2003 | Morii et al. | |
| 6,660,983 | B2 | 12/2003 | Monforton et al. | |
| 6,733,807 | B2 | 5/2004 | Martuch et al. | |
| 6,818,873 | B2 | 11/2004 | Savage et al. | |
| 2004/0035859 | A1 | 2/2004 | Childress et al. | |
| 2004/0169037 | A1* | 9/2004 | Roussel et al. | 219/731 |
| 2005/0112263 | A1* | 5/2005 | Schmitt | 426/573 |

* cited by examiner

MICROWAVEABLE PACKAGE HAVING A STEAM SOURCE

BACKGROUND OF THE INVENTION

1. Technical Field

The present invention relates to the packaging of microwaveable food products and more specifically it relates to the packaging of microwaveable half-products.

2. Description of Related Art

Microwave ovens have become common devices used to cook and reheat food products and 95% of all households in the United States own at least one microwave oven. Consequently, there is a large market for microwaveable foods. Microwave ovens cook food products differently from conventional ovens in that microwave ovens emit radio waves (microwaves) at a certain frequency. Polar molecules such as water attempt to rotate with the microwave electric field and ions such as sodium and chloride tend to move linearly back and forth with the microwave electric field. Energy is thereby transferred to the molecules or ions from the electric field. The motions of these molecules are in turn transferred to the other molecules in the food as heat.

One problem with using microwaves for heating or cooking food products is that there is great potential for hot and cold spots to occur. The unevenness of the heating can be microwave dependent due to the variation of electric field within the oven cavity depending upon the type or brand of microwave oven and the wattage of the microwave oven. Further, problems surrounding the unevenness of the heating can be further compounded by a food dependency component due to the different rates of energy absorption by different ingredients within the food and/or the geometry of the food product. Consequently, a need exists for a microwavable package that promotes more even temperature distribution within a microwave oven independent of the brand and wattage of microwave oven.

Many prior art solutions directed towards solving the problem of uneven temperature distribution have been proposed. For example, U.S. Pat. No. 4,132,811 teaches a two-compartment package. One compartment has a food product to be cooked and the other compartment is an expandable vessel with a vaporizable liquid. The package is placed into a microwave and exposed to microwave energy. The liquid volatilizes thereby causing the compartment having the food product to move within the microwave oven. The resultant movement of the food helps to distribute non-uniform microwave energy.

U.S. Pat. No. 4,987,280, assigned to the same assignee of the present invention, is directed towards heating a shelf-stable, low moisture content food product. The '280 Patent discloses placement of a sealed packet having an aqueous liquid with a dielectric material into a sealed package. Upon exposure to microwave radiation, the contents of the sealed packet rapidly volatilize. The packet's design is such that a seal failure will occur when the interior temperature and pressure reach a predetermined point. Upon seal failure, the volatilized contents disperse throughout the sealed package. In addition, the '280 Patent limits its usefulness or scope to foods with less than 5% (by weight) of moisture.

U.S. Pat. No. 6,455,084 is directed towards placing an absorbent pad having a permeable side and an impermeable side upon a food product. The absorbent pad is moistened with purified water and the impermeable side is placed on a food product, such as a frozen tamale. Upon heating in a microwave, the pad shields the food product from direct microwave radiation and serves as a source of steam generation. The patent indicates that the additional moisture from the pad also helps to keep the food product moist.

Additionally, many packages are expressly designed to be used to store and cook microwaveable popcorn. For example, U.S. Pat. No. 5,488,220, discloses a bag for microwave cooking. The '220 Patent is directed towards a package that controls movement of food product (kernels) within a bag during popping in the microwave. The '220 Patent achieves its purpose by preventing formation of pockets or shelves defined by the corner flaps at the gusseted side panels of a bag to avoid or minimize entrapment of kernels in these pockets to increase the yield of popped kernels.

U.S. Pat. No. 4,596,713 discloses a microwave food package for preparing foods such as shelf-stable popcorn containing a packet of food additive or flavoring which is automatically dispersed over the food product when the package is heated by microwave radiation. The '173 patent discloses the packet can be either a separate bag-like receptacle or part of the inner upper center wall of the package. This package is directed towards distribution of flavoring on the food product.

Although there are numerous teachings in the prior art regarding microwave packages, the prior art fails to disclose a solution to the problem of microwave cooking being dependent upon the brand and wattage power of a microwave oven. Another solution to the problem of cooking a food product in microwaves having different wattages is to place directions on a package that are specific to the power of a microwave. For example, a consumer can be instructed to heat a food product in a particular package for some period of time in an 800 watt oven or for a lesser time in an 1100 watt oven. Unfortunately, many consumers do not know the wattage of their microwave oven, increasing the frustration of the consumer upon reading the directions. Consequently, a need exists for a microwaveable food package that can increase product robustness, e.g. a package and method for cooking food products to an acceptable level with the same cooking time range in microwaves having varying degrees of wattage.

Such packaging can be especially helpful for cooking various food products, such as half-products that, unlike microwave popcorn, provide no audio cue that the product is ready. For example, half-products gradually expand upon microwave heating to form puffed pieces. Examples of such half-products are disclosed in U.S. Pat. Nos. 4,251,551 and 4,409,250. The package should prevent condensation or dew upon the food product during storage and cooking and should be economical to manufacture. The package should be capable of keeping the enclosed food product shelf-stable.

SUMMARY OF THE INVENTION

The proposed invention is a package and method that permits a pre-packaged microwavable food to be cooked to a desired consistency in a wide variety of microwave ovens having varying power levels.

In one aspect, control of heat imparted to the food product is achieved by a steam emitting source in porous communication with the food product. The food product package having food product is then microwave heated causing a liquid within the steam emitting source to boil, vaporize, and contact food in the primary package. In one aspect, the steam emitting source comprises an absorbent material partially or fully saturated with an aqueous solution. In one aspect, the steam emitting source comprises a gel system. The food product is then microwave heated causing the water in the steam emitting source to evaporate and form steam. The steam blankets the food product and permits even heating of the food product. The instant invention provides an expanded time window that results in more consistent heating of the food product than was permitted in the prior art. In one aspect, the instant invention thereby provides a retail package having a half-product that can be satisfactorily heated in a broad range of microwave ovens. The above as well as additional features and advantages of the present invention will become apparent in the following written description.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

The present invention is directed towards a package and method that provides for a better heat distribution within a microwave oven to improve food product robustness. As used herein, food product robustness is defined as consistent food quality throughout a food product heated in a microwave oven independent of the type of microwave used. Food quality can be defined in terms of the evenness of the temperature distribution within a food, at the food's surface, or in terms of the uniform effect heating has on the product. For example, in the cooking of a frozen food product, the evenness of temperature distribution is important to avoid hot and cold spots within the heated food product. Similarly, in the cooking of half-product pellets, the effect of an even temperature distribution is a consistency in the amount of expansion of the various pellets after heating in a microwave. It has been discovered that controlling the heating of the product and the product moisture loss by providing a blanket of steam within the microwave package can result in an expanded time window. The time window is the amount of time that the food product cooks in the microwave without undesirable undercooking or overcooking. The expansion of the time window is important as it improves the consistency of food product when the food product is heated for a certain period of time, independent of the brand or wattage of a microwave oven. For example, the expanded time window for a food product heated in accordance with one embodiment of this invention can be cooked for between 90 and 100 seconds in a 600-watt microwave oven and for 60 to 100 seconds in an 1100-watt microwave oven. Hence, the food product can be cooked in either oven for 90 to 100 seconds and yield a food product having a relatively high and consistent level of quality. The above example is given merely as an illustration and is in no way meant to convey any such limitation.

Figure 1:
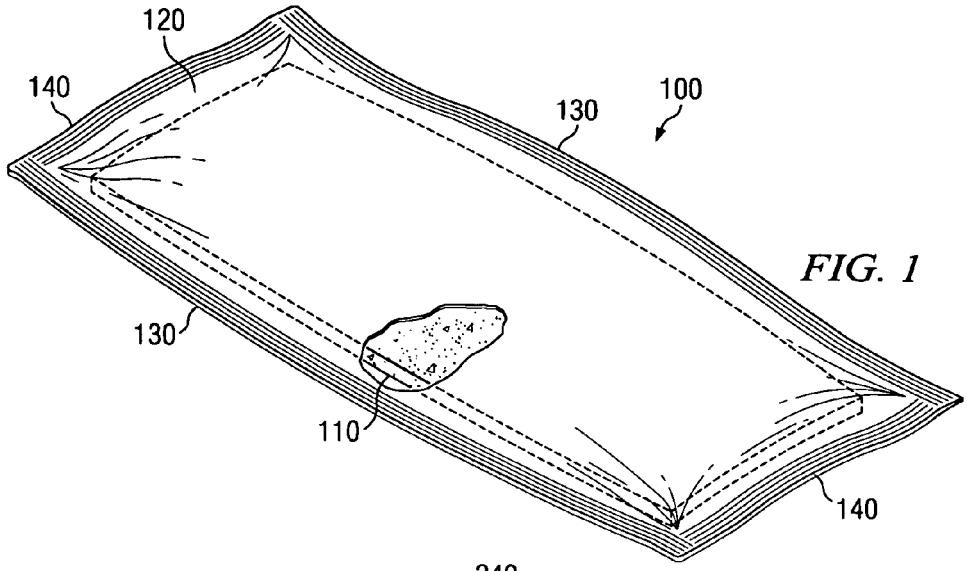
FIG. 1 is a perspective view of a steamer pack in accordance with one embodiment of the present invention.

FIG. 1 is a perspective view of a steam pack assembly in accordance with one embodiment of the present invention. In one embodiment, this steam pack assembly 100 controls the release of the steam while the food product is heated in the microwave. As shown, the steam pack assembly 100 comprises a steam emitting source 110 surrounded by an outer wrapping 120. In one embodiment, the steam emitting source 110 comprises an absorbent material placed into the outer wrapping 120 and the outer wrapping 120 is then hot-filled with an aqueous solution. The size of the material and the amount of aqueous solution added to the material can be based upon such variables as amount of food product, type of food product, the various wattages of microwave ovens being used by the consumer, and the type and amount of aqueous solution utilized.

The steam source 110 can be made of any absorbent material that is microwave safe. In one embodiment, the absorbency of the material and the surface area should be sufficient to fully absorb the added aqueous solution. In one embodiment, the steam emitting source comprises an absorbent spun-polyester cloth-like material. In one embodiment, the steam pack 100 comprises a steam pad 110 made of a cloth-like material and contains less than 50 milliliters of an aqueous solution. In one embodiment, the steam emitting source 110 contains an aqueous solution selected from group consisting of water, saline, oil, flavorants, anti-microbial agents, and mixtures thereof. The outer wrapping 120 can comprise a polymeric film produced from a microwavable material such as polypropylene, polyethylene terephthalate, nylon, cellophane, etc.

In one embodiment the steam source 110 comprises a gel system. One advantage of using a gel system is that a gel holds or binds the liquid in semi-solid form. Thus, in the event that the outer wrapping 120 develops a leak, little or no liquid will come into contact with the food product before, during, or after heating. When the gel is heated, steam is emitted from the gel. Gel systems suitable for the purpose of the invention can be selected from a variety of food grade polymers and can include hydrocolloids, combinations of starches and hydrocolloids, proteins, alcohols, and combinations thereof. Hydrocolloids suitable for the purpose of the invention can be selected from a variety of food-contact acceptable polymers. These are known, conventional materials examples of which include modified cellulose ethers including methylcellulose, hydroxypropyl methylcellulose, carboxymethylcellulose, and hydroxypropyl cellulose; gelatin, water soluble cellulose acetate, polyvinyl pyrrolidone, starches, alginates, carrageenan, pectins, alginic acid, seed extracts such as locust bean and guar, and tragacanth, arabic, karoya, gellan gum, gum ghatti, xanthan, and agar gums. The preferred hydrocolloids for use in the present invention are carageenan blends with locust bean gum, alginates, gellan gum, xanthan gum, and mixtures thereof. In one embodiment, the hydrocolloid can be used with or without gelling salts and the hydrocolloid comprises between about 0.25 to about 1.0% by weight of the gel.

A gel system having combination of starches and hydrocolloids suitable for the purpose of the invention can include any starch that can form a gel or solid-type of structure. Such combinations can include modified and native starches from corn, wheat, rice, potato, tapioca, oats, and other relatively high starch materials and a hydrocolloid including gum arabic and chitosan. In one embodiment, a starch-hydrocolloid combination comprises more than 1% by weight of the gel.

A gel system comprised of concentrated protein concentrates and isolates including, but not limited to, whey proteins, soy proteins, wheat proteins, corn proteins including gluten and zein, potato proteins, rice proteins, sorghum proteins, gelatin, collagen, keratin, and mixtures thereof can be used. A gel system can also comprise alcohols including, but not limited to polyhydric alcohols such as polyethylene glycol, cetyl alcohol, and mixtures thereof. In one embodiment, the gel system comprises a methacrylate polymer.

The gel systems discussed above can be used in combination and are provided for purposes of illustration and not limitation. Any set of ingredients that can form a food safe gel can be used.

The outer wrapping 120 can prevent direct contact with the steam source 110 and the food product. Direct contact with the steam emitting source 110 and the food product is undesirable because moisture (liquid) rather than steam (gas) can contact the food product. Similarly, any condensation that contacts the food product is also undesirable. Moisture or condensation in contact with some food products can make certain food products soggy. Similarly, in some food products including half-products, condensation can lead to hard areas within the cooked product and facilitate pieces of food "welding" undesirably together into larger, congealed pieces. Further, condensation can prevent optimal expansion of a half-product. Hence, in accordance with one embodiment of the present invention, the steam source 110 is disposed in porous communication with a food product. As used herein, porous communication means that a porous barrier exists between steam source 110 and the food product such that the source 110 itself does not contact the food product, yet the volatilized components from the source are in communication with the food product. The food product should not be in direct contact with the steam source 110.

Figure 2A:
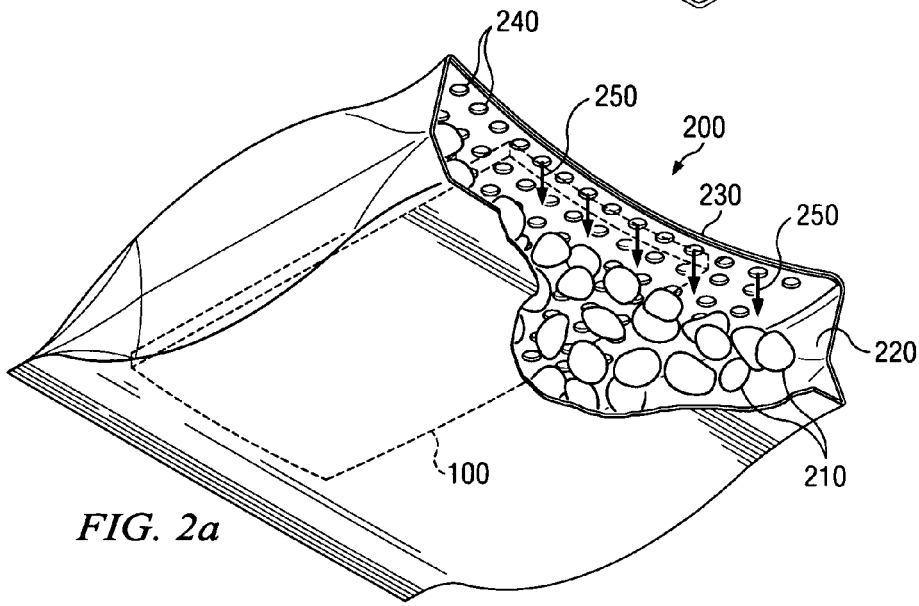
FIG. 2*a* is a cut-away perspective view of a package in accordance with one embodiment of the present invention.
Figure 2B:
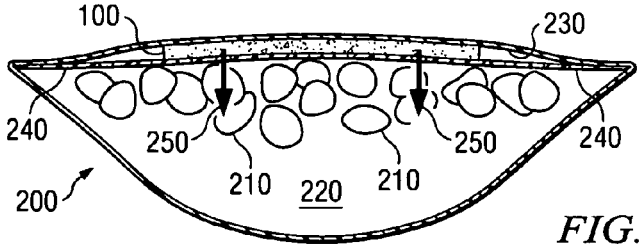
FIG. 2*b* is a cross-sectional side view of the package depicted in FIG. 2*a;*

Porous communication between the steam source 110 and a food product can be provided by an outer wrapping 120 or by a multi-compartment package or a package having a pouch. FIG. 2*a* is a cut-away perspective view of a package in accordance with one embodiment of the present invention. FIG. 2*b* is a cross-sectional side view of the package depicted in FIG. 2*a*. The package in FIGS. 2*a* and 2*b* can be made in accordance with the description set forth in U.S. patent application Ser. No. 11/036,802, entitled, "Multi-Compartment Packages," filed on Jan. 14, 2005 and assigned to the same assignee as the present invention. In one embodiment, half-product 210 is placed in a food compartment 220 and a moisture pack 100 is placed into a steamer pack compartment 230. The food compartment 220 and steamer pack compartment 230 are separated by a porous 240 wall. In the embodiment shown, the food product package 200 having the half product 210 and steamer pack 100 is placed into a microwave and cooked for a period of time. The aqueous solution in the steam source within the steamer pack 100 volatilizes into steam, blankets the food product 210 below, and uniformly cooks the product 210.

Referring to FIGS. 1, 2*a*, and 2*b*, in one embodiment, the steam escapes from the outer wrapping 120 by causing seal failure along the long edge seals 130 and/or the short edge seals 140. The long edge seals 130 and/or short edge seals 140 can be designed to fail at a certain temperature by addition of contaminants into the outer wrapping 120 film by methods known in the art. Alternatively, the long edge seals and/or short edge seals can be partial seals which can create channels to permit steam to escape. In an alternative embodiment, a steam emitting source 110 with no outer wrapping 120 is placed into the steamer pack compartment 230 and the porous 240 wall alone provides the necessary porous communication. In either of the above embodiments, steam can then migrate in the direction of the arrows 250 and the food compartment 220. Although depicted as being disposed near the top of the package in FIGS. 2*a* and 2*b*, the steam pack 100 can be placed on the side, bottom, or top of a multi-compartment package.

In one embodiment, a steam pack 100 or a steam pad 110 can be laminated into a package having a false bottom and channels can be provided for steam to escape into the main chamber. In a preferred embodiment, the steam pack 100 is placed above the food product along the top center portion of an expandable package and channels are provided for steam escape. The porous steam pack 100 can be adhered, by adhesive, extrusion lamination techniques, or other commonly available methods to an inner package wall. Embodiments utilizing channels may be advantageous to prevent contact by a consumer upon opening of the package and accessing the food product after microwave heating as the steam pack may have an elevated temperature for a period of time after the food product has been cooked.

Figure 3A:
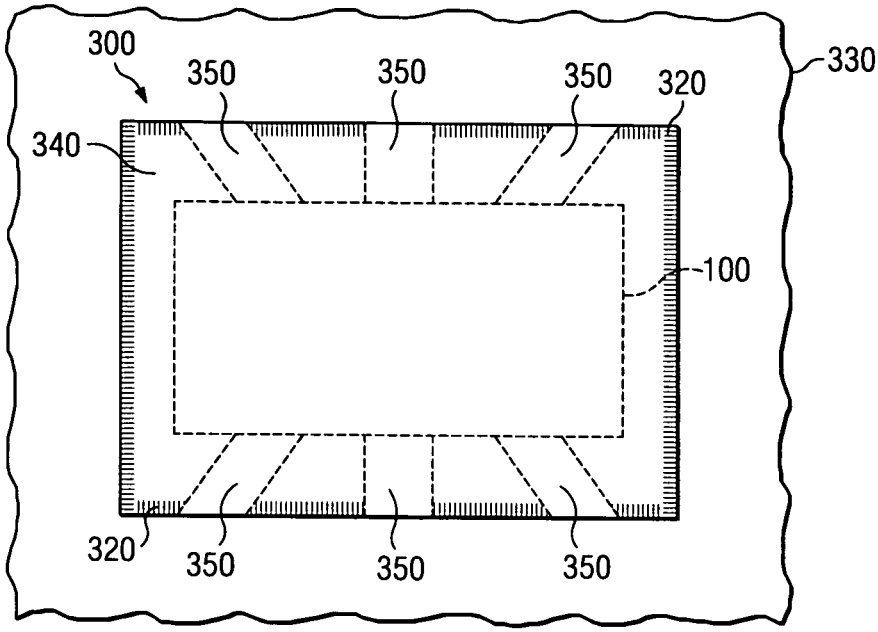
FIG. 3*a* depicts a view of the steam pack attached to the top wall of a package in accordance with one embodiment of the present invention.

FIG. 3*a* depicts a view of the steam pack attached to an interior package wall in accordance with one embodiment of the present invention. Referring to FIG. 3*a*, a steamer pack assembly 300 comprises a steam pack 100 immediately adjacent to an interior package wall 330. A piece of material 340 such as a paper-laminate can be placed over the steam pack 100 and adhered 320 to the interior package wall 330. A plurality of channels 350 can be provided with the use of pattern applied sealants to permit the steam to escape from the channels 350 into the main package area.

Figure 3B:
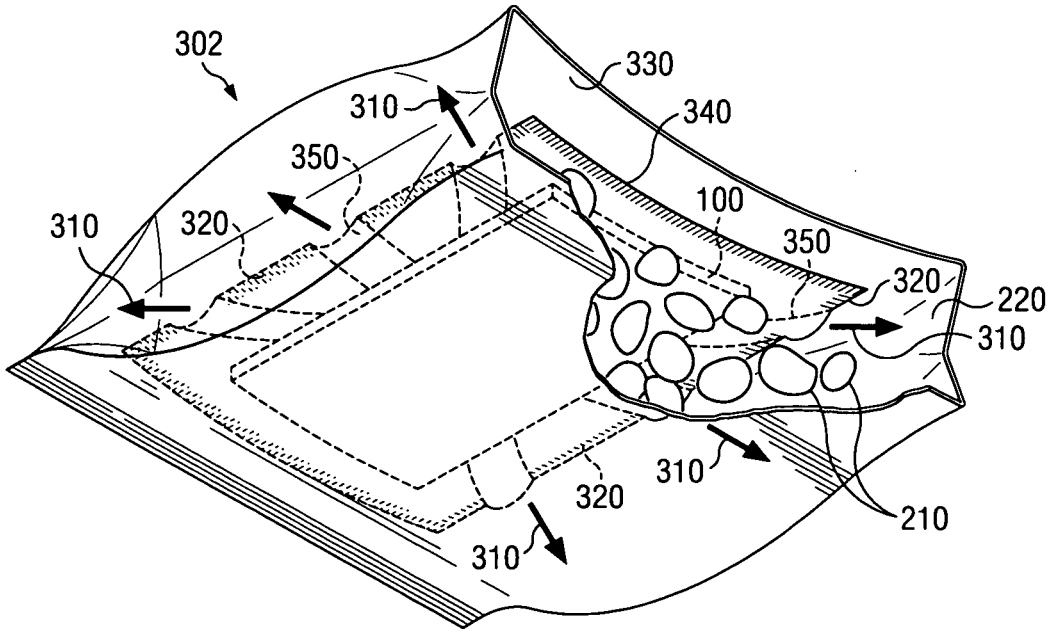
FIG. 3*b* is a cut-away perspective view of a package in accordance with one embodiment of the present invention.
Figure 3C:
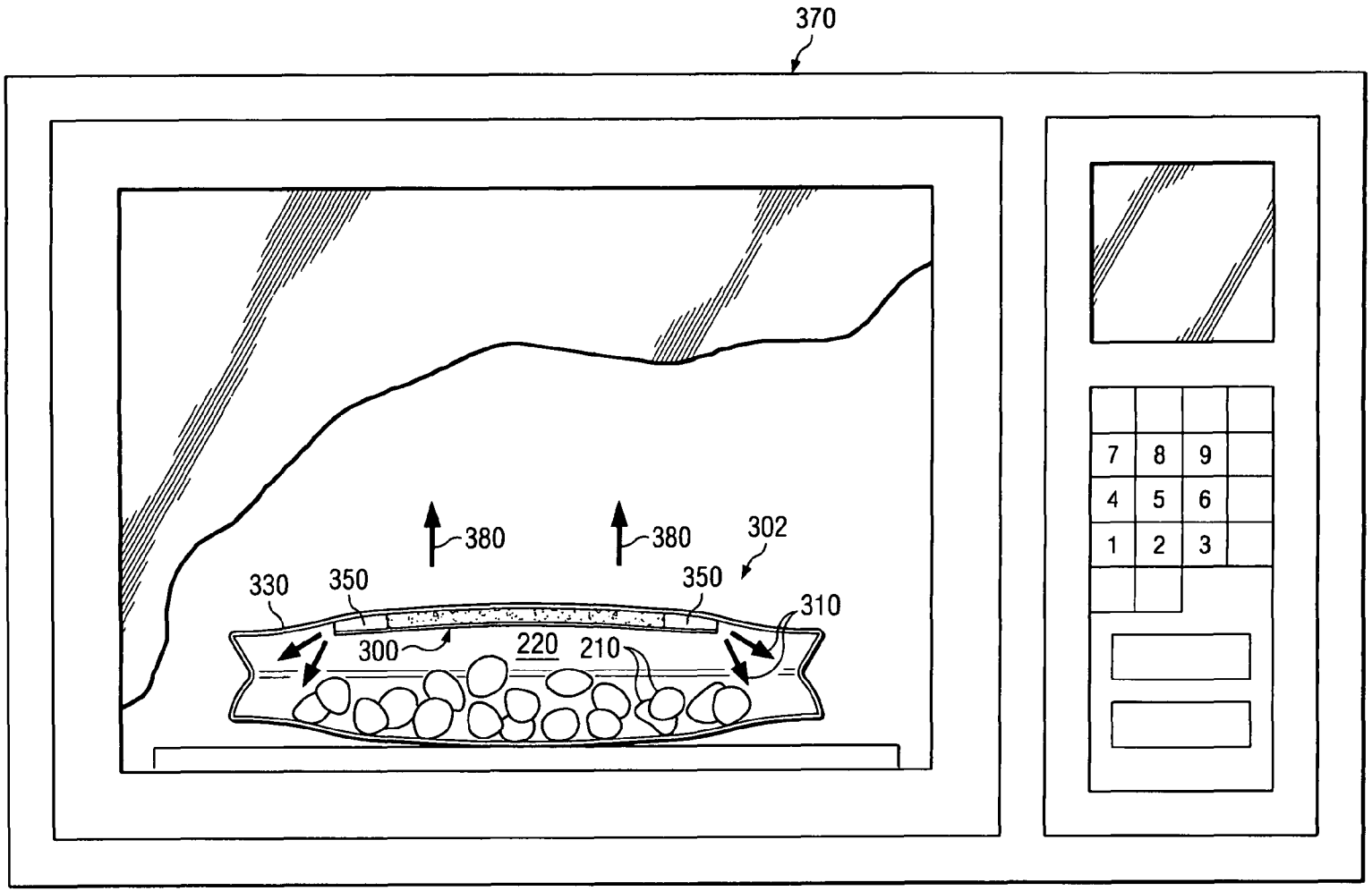
FIG. 3*c* is a cross-sectional front view of the package depicted in FIG. 3*b*.

FIG. 3*b* is a cut-away perspective view of a package in accordance with one embodiment of the present invention. FIG. 3*c* is a cross-sectional front view of the package depicted in FIG. 3*b* being heated in a microwave oven. Referring to FIGS. 1, 3*b* and 3*c*, a steam pack assembly 300 having a plurality of channels 350 and a steam pack 100 is disposed in the top of a microwave package 302 and placed in a microwave 370. During microwave heating the steam pack edge seals 130 140 fail permitting steam to escape from the steam pad 100. As the bag expands in the direction of the arrows 380 during microwave heating, the steam that has escaped through the edge seals 130 140 moves through the channels 350, as indicated by the arrows 310, and blankets the food product in the food compartment 220 below. Use of a steam pad 110 can be especially advantageous in such geometrical embodiment because the steam pad 110 holds the liquid against the forces of gravity and substantially lowers the risk of liquid dropping onto the food product below. Other package configurations, including flexible-based packages made from typical kraft or bleached paper-based microwavable packages, as well as rigid-based containers can be used.

Without being bound to theory, it is believed that the inclusion of the additional moisture to the package by a steam pad or gel helps to expand the time window by controlling moisture loss during microwave heating. Thus, additional energy provided by a higher power microwave oven can be absorbed by the liquid water as it is converted to vapor from the steam pad. Thus, the heat of vaporization required to volatilize the aqueous liquid in the steam further acts as an additional heat sink. Further, the steam acts to distribute the heat within the food product and within the microwave oven because it blankets the food product with thermal energy more evenly than microwave radiation alone. Additionally, the moisture in the package also helps equilibrate moisture distribution between pellets during cooking.

In one embodiment a microwave susceptor is attached to the steam pack. A microwave susceptor can focus the microwave energy on the steam pack to provide steam early in the cooking process. Such embodiment may be helpful to quickly convert radiant energy into thermal energy and balance out the consistency of hot and cold spots within the microwave oven. It has also been discovered that when the aqueous solution in the steam pad comprises water saturated with sodium chloride, the rate of steam release was enhanced. Hence, in one embodiment, the steam source comprises saline or salt water.

Example

Several microwave packages with steam packs were made in the following manner: Approximately two ounces of half product were placed into a microwaveable package having a steam pack adhered to the top of the package. A 4-inch×6¼-inch sheet of absorbent spun-polyester was folded into a 1½-inch by 2-inch rectangle and placed into an overwrapping made of PET with a polyolefin sealant with 6 milliliters of 3% salt (NaCl) solution. The steam pack comprised of the sheet and solution was then sealed and adhered to the top of a paper-based microwave package. The same amount of product was placed into microwave packages with no steam packs. Both types of packages were then microwaved in an 1100-watt microwave oven and a 600-watt microwave oven.

Figure 4:
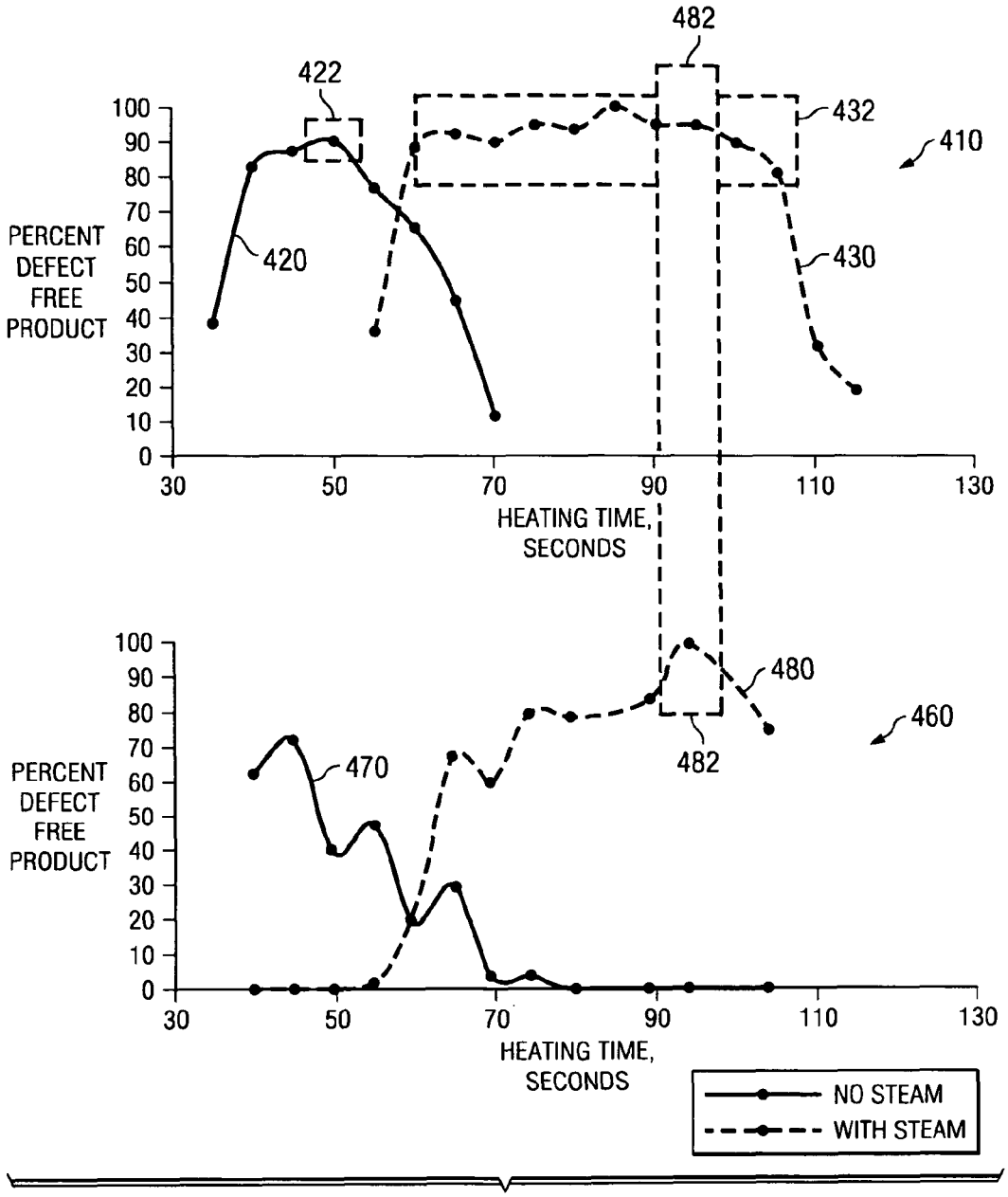
FIG. 4 depicts two graphical representations depicting percentages of defect-free product vs. cooking time for two differently-powered microwave ovens with and without a steam source in accordance with one embodiment of the invention.

FIG. 4 depicts two graphical representations depicting percentages of defect-free product vs. cooking time for two differently-powered microwave ovens with and without a steam source in accordance with one embodiment of the invention. As used herein, a product defect occurs when a half-product displays any burning or non-expanded portions of product from either over- or under-cooking. Similarly, defect-free product has very little or no blackening from overcooking. The top graph 410 depicts the relationship showing the percentage of defect-free product vs. cooking time for product heated in an 1100 watt microwave oven. The first defect free curve 420 is plotted from data obtained from product heated in an 1100 watt microwave oven from a microwave package without a steam pack. The two-ounce half-product samples were microwaved in 5 second increments beginning at 35 seconds and ending at 70 seconds. The samples were analyzed for defect free product. As illustrated by the curve 420, there is an approximately 2 to 3 second window 422 of time where the product is 90% free of defects.

The second defect free curve 430 is plotted from data obtained from product heated in an 1100 watt microwave oven from a microwave package having a steam pack. The two-ounce half-product samples were microwaved in 5 second increments beginning at 55 seconds and ending at 115 seconds. The samples were analyzed for defect free product. As illustrated by the curve 430, there is an approximately 40 second window 432 of time where the product is 90% free of defects. Hence the time window was expanded by a factor of more than 10.

The bottom graph 460 depicts the relationship showing the percentage of defect-free product vs. cooking time for product heated in a 600 watt microwave oven with and without a steam pack. The first defect free curve 470 is plotted from data obtained from product heated in a 600 watt microwave from a microwave package without a steam pack. The two-ounce half-product samples were microwaved in 5 second increments beginning at 40 seconds and ending at 105 seconds. As illustrated by the curve 470, there is no window of time where the product is 90% free of defects.

The second defect free curve 480 is plotted from data obtained from product heated in a 600-watt microwave from a microwave package having a steam pack. The two-ounce half-product samples were microwaved in 5 second increments beginning at 40 seconds and ending at 105 seconds. As illustrated by the curve 480, there is an approximately 8 second window 482 of time where the product is 90% free of defects. Hence, the instant invention provides a way that permits half-product to be used by a segment of the market having lower-powered microwaves. Lower powered, 600-watt microwaves are common in college dormitories, as well as kitchenettes. Such places are ideal for a convenience food that needs only to be heated in the microwave. Further, because this same 8 second window, namely the time from about 90 seconds to about 100 seconds also exists in the 1100 watt microwave, the instant invention provides a microwaveable package that produces 90% defect free product for a fixed time frame in a microwave ovens having varying powers. The instant invention thereby provided a package and method for providing an expandable half-product for cooking in a broad range of microwaves with a lessened risk of potential burning due to the expanded time window.

It should be noted that the above example is given for purposes of illustration and not limitation. For example, the size of the steam pack and the amount of liquid in the steam pack can be varied to optimize the expanded time window. Such modifications may be desirable to manufacture one set of packages designed for low-powered microwaves that can be directed towards places such as dormitories and another set of packages designed for higher-powered microwaves that can be directed towards places such as homes.

The present invention has many benefits. First, it provides for more even temperature distribution within a microwave oven. Second, it expands the time window within a microwave oven that food can be cooked to an acceptable level of quality. Third, it enhances the consistency to the amount of expansion that is imparted to a plurality of expandable pellets within a food package during microwave heating. Fourth, it provides a more consistent level of quality in a food product independent of the wattage or brand of microwave oven used to heat or cook the food product thereby increasing product robustness.

While this invention has been particularly shown and described with reference to a preferred embodiment, it will be understood by those skilled in the art that various changes in form and detail may be made therein without departing from the spirit and scope of the invention.

What is claimed is:

1. A retail package having a food product intended to be heated in the package by a microwave oven, said package comprising:

a food product, wherein said food product is shelf-stable and a steam pack adhered to an interior package wall, said steam pack comprising:

an overwrapping having a weakened edge seal; and a steam emitting source comprising an absorbent material capable of absorbing an aqueous solution, said steam emitting source in porous communication with said food product upon failure of said weakened edge seal, wherein said steam emitting source comprises sufficient moisture to create a steam atmosphere in said package when said package is heated in a microwave oven and further wherein no liquid from said steam emitting source comes into contact with said food product.

2. The retail package of claim 1 wherein said steam emitting source comprises an absorbent material partially or fully saturated by an aqueous solution, said material being surrounded by said outer wrapping.

3. The retail package of claim 1 wherein said food product is a half-product.

4. The retail package of claim 1 wherein said steam emitting source contains an aqueous solution selected from group consisting of water, saline, oil, flavorants, anti-microbial agents, and mixtures thereof.

5. The retail package of claim 1 wherein said steam emitting source comprises a gel system.

6. The retail package of claim 5 wherein said gel system is selected from food grade polymers consisting of hydrocolloids, combinations of hydrocolloids and starches, proteins, alcohols, and combinations thereof.

7. The retail package of claim 5 wherein said gel system is selected from the group of hydrocolloids consisting of carageenan blends with locust bean gum, alginates, gellan gum, xanthan gum, and mixtures thereof.

8. The retail package of claim 1 wherein said steam pack is attached to a top portion of said package.

9. The retail package of claim 1 wherein said steam pack is held in place by a piece of material having a plurality of channels to permit steam to escape.

10. The retail package of claim 1 wherein said steam pack is laminated to an interior package wall.

11. A method for making a retail package having a food product intended to be heated in the package by a microwave oven, said method comprising the steps of:

a) providing a package comprised of materials suitable for use in a microwave oven;

b) adhering a steam pack having a steam emitting source to an interior package wall, wherein said steam emitting source comprises an absorbent material capable of absorbing an aqueous solution; and c) placing a food product in said package, wherein said steam emitting source, upon an edge seal failure, is in porous communication with said food product and no liquid from said steam emitting source comes into contact with said food product.

12. The method of claim 11 wherein said steam emitting source comprises an absorbent material partially or fully saturated by an aqueous solution, said material being surrounded by an outer wrapping.

13. The method of claim 11 wherein said food product is shelf-stable.

14. The method of claim 11 wherein said food product is a half-product.

15. The method of claim 11 wherein said steam source contains an aqueous solution selected from group consisting of water, saline, oil, flavorants, anti-microbial agents, and mixtures thereof.

16. The method of claim 11 wherein said steam source comprises a gel system.

17. The method of claim 16 wherein said gel system is selected from food grade polymers consisting of hydrocolloids, combinations of hydrocolloids and starches, proteins, alcohols, and combinations thereof.

18. The method of claim 16 wherein said gel system is selected from the group of hydrocolloids consisting of carageenan blends with locust bean gum, alginates, gellan gum, xanthan gum, and mixtures thereof.

19. The method of claim 11 wherein said steam pack is attached to a top portion of said package.

20. The method of claim 11 wherein said attaching at step b) comprises placing said steam pack between a piece of material adhered to said inner package wall, said piece of material having a plurality of channels to permit steam to escape.

21. The method of claim 11 wherein said adhering at step b) comprises laminating said steam pack to an interior package wall.

* * * * *